US006261757B1

(12) United States Patent
Irving et al.

(10) Patent No.: US 6,261,757 B1
(45) Date of Patent: Jul. 17, 2001

(54) PHOTOGRAPHIC ELEMENT COMPRISING AN ION EXCHANGED REDUCING AGENT

(75) Inventors: Lyn M. Irving; John M. Noonan; Mark E. Irving, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/593,069

(22) Filed: Jun. 13, 2000

(51) Int. Cl.[7] ..... G03C 1/42
(52) U.S. Cl. ..... 430/566; 430/362; 430/448
(58) Field of Search ..... 430/566

(56) References Cited

U.S. PATENT DOCUMENTS

| | | | | |
|---|---|---|---|---|
| 3,342,599 | | 9/1967 | Reeves | 430/371 |
| 4,060,418 | | 11/1977 | Waxman et al. | 430/212 |
| 4,157,915 | | 6/1979 | Hamaoka et la. | 430/505 |
| 4,438,195 | | 3/1984 | Kunitz et al. | 430/566 |
| 5,019,492 | | 5/1991 | Buchanan et al. | 430/543 |
| 5,976,773 | * | 11/1999 | Fernandez-Puente | 430/447 |

* cited by examiner

*Primary Examiner*—Hoa Van Le
(74) *Attorney, Agent, or Firm*—Edith A. Rice; Sarah Meeks Roberts

(57) ABSTRACT

A photographic element comprises at least one light-sensitive layer on a support wherein the photographic element also comprises a particulate ion exchange material having an average particle size of about 0.01 to about 10 $\mu$m and comprising at least one reducing agent ionically bound to an ion exchange matrix.

34 Claims, 2 Drawing Sheets

PHOTOGRAPHIC ELEMENT COMPRISING AN ION EXCHANGED REDUCING AGENT

FIELD OF THE INVENTION

This invention pertains to photographic elements, and in particular to photographic elements incorporating reducing agents stabilized using ion exchange polymers, a method of activating the reducing agent, and a method of processing said photographic element.

BACKGROUND OF THE INVENTION

It is well known in the art that the introduction of photographically useful compounds, such as photographic developers, couplers, development inhibitors, electron transfer agents, base precursors, fixing agents, i.e., ligand capable of binding silver, silver stabilizing agents and the like, into photographic elements can lead to premature reaction of the photographically useful compound with the other components of the photographic element. For example, placing conventional color developers, such as p-phenylenediamines and p-aminophenols, into sensitized photographic elements leads to desensitization of the silver halide emulsion and unsuitable fog. Much effort has therefore been directed at trying to produce effective blocked developers, which can be introduced in silver halide emulsion elements without deleterious desensitization or fog effects and which unblock chemically under conditions of development so that developer is free to participate in color forming (dye forming) reactions.

U.S. Pat. No. 3,342,599, to Reeves, discloses the use of Schiff base developer precursors. U.S. Pat. No. 4,157,915, to Hamaoka et al., and U.S. Pat. No. 4,060,418, to Waxman and Mourning, describe the preparation and use of carbamate blocked p-phenylenediamines. Color developing agents having α-ketoacyl blocking groups are described in U.S. Pat. No 5,019,492.

All of these approaches and inventions have failed in practical product applications because of one or more of the following problems: desensitization of sensitized silver halide; unacceptably slow unblocking kinetics; instability of blocked developer yielding increased fog and/or decreased Dmax after storage; and the requirement of a dinucleophile, such as hydroxylamine, to initiate developer release.

The addition of a blocking group to a color developing agent results in an increase in molecular weight and generally results in a decrease in water solubility of the resulting blocked version of the parent color developing agent. As a result, the incorporation of these blocked developers in photographic elements is carried out using colloidal gelatin dispersions of the blocked developers. These dispersions are prepared using means well known in the art, wherein the developer precursor is dissolved in a high vapor pressure organic solvent (for example, ethyl acetate), along with, in some cases, a low vapor pressure organic solvent (such as dibutylphthalate), and then emulsified with an aqueous surfactant and gelatin solution. After emulsification, usually done with a colloid mill, the high vapor pressure organic solvent is removed by evaporation or by washing, as is well known in the art.

PROBLEM TO BE SOLVED BY THE INVENTION

There has been a need for a photographic element incorporating a reducing agent, such as a developing agent, which is stable until development. Then, the element can be developed rapidly and easily. There has also been a need to simplify the preparation of the developer dispersion method and to eliminate the need for organic solvents in coating formulations. There has also been a need for a process for developing an image in a photographic element which employs a developing solution having a simplified composition.

SUMMARY OF THE INVENTION

These and other needs have been satisfied by providing photographic elements comprising polymers with ion exchangeable groups (ionomers, polyesterionomers, and ion-containing latices) which limit diffusion of reducing agents under coating conditions. The immobilization of the reducing agent prevents interaction with the silver halide emulsion under film storage conditions. The active reducing agent can be released from the ion exchange polymer by contacting the film with a high ionic strength solution and/or a solution of appropriate pH to release the active compound from the ion exchange polymer, and/or raising the temperature to release the active reducing agent. In the case of developer release, for example, the high pH environment initiates developer release by deprotonating the developer molecule. This breaks the ionic interaction between the previously protonated developer and the ion exchange polymer, allowing the developer molecules to diffuse away from the ion exchange polymer. A second driving force for developer diffusion can be provided by immersion in a high ionic strength solution. In this case, the high concentration of ions in the activating solution compete with the developer for the exchange sites of the ion exchange polymer, which tends to displace the developer from the exchange sites.

One aspect of the invention comprises a photographic element comprising at least one light-sensitive silver halide layer on a support, wherein the photographic element also comprises at least one reducing agent ionically bound to a particulate ion exchange matrix having an average particle size of about 0.01 to about 10 μm.

The ion exchanged reducing agent can be incorporated in a photographic element within a light-sensitive layer or within a light-insensitive layer adjacent a light sensitive layer.

Another aspect of this invention comprises a method of activating a reducing agent incorporated in a photographic element which comprises a support and at least one light-sensitive layer and at least one reducing agent ionically bound to a particulate ion exchange matrix having an average particle size of about 0.01 to about 10 μm, said method comprising contacting the element with a solution or solution contained within a coated binder having an ionic strength of greater than 0.001 M.

Yet another aspect of this invention comprises a method of activating a reducing agent incorporated in a photographic element which comprises a support, at least one light sensitive layer and at least one reducing agent ionically bound to a particulate ion exchange matrix having an average particle size of about 0.01 to about 10 μm, said method comprising heating the element to a temperature above about 50° C.

Still another aspect of this invention comprises a method of processing the photographic element comprising a support, at least one light-sensitive layer and at least one reducing agent ionically bound to a particulate ion exchange matrix having an average particle size of about 0.01 to about 10 μm, said method comprising contacting the element with a processing solution having a pH greater than 8.

A further aspect of this invention is a method of imaging comprising the steps of:

forming an image in an imagewise exposed light-sensitive silver halide element comprising a support, a light-sensitive silver halide emulsion layer, and a reducing agent ionically bound to a particulate ion exchange material having an average particle size of about 0.01 and about 10 $\mu$m;

scanning said formed image to form a first electronic image representation from said formed image;

digitizing said first electronic image to form a digital image;

modifying said digital image to form a second electronic image representation; and transforming, storing, transmitting, printing or displaying said second electronic image representation.

An additional aspect of this invention is a method of forming an image comprising the steps of:

forming an image in an imagewise exposed light-sensitive silver halide element comprising a support, a light-sensitive silver halide emulsion layer, and a reducing agent ionically bound to a particulate ion exchange material having an average particle size of about 0.01 and about 10 $\mu$m;

scanning said formed image to form an electronic image representation from said formed image; and transforming, storing, transmitting, printing or displaying said electronic image representation.

DETAILED DESCRIPTION OF THE INVENTION

Figure 1:
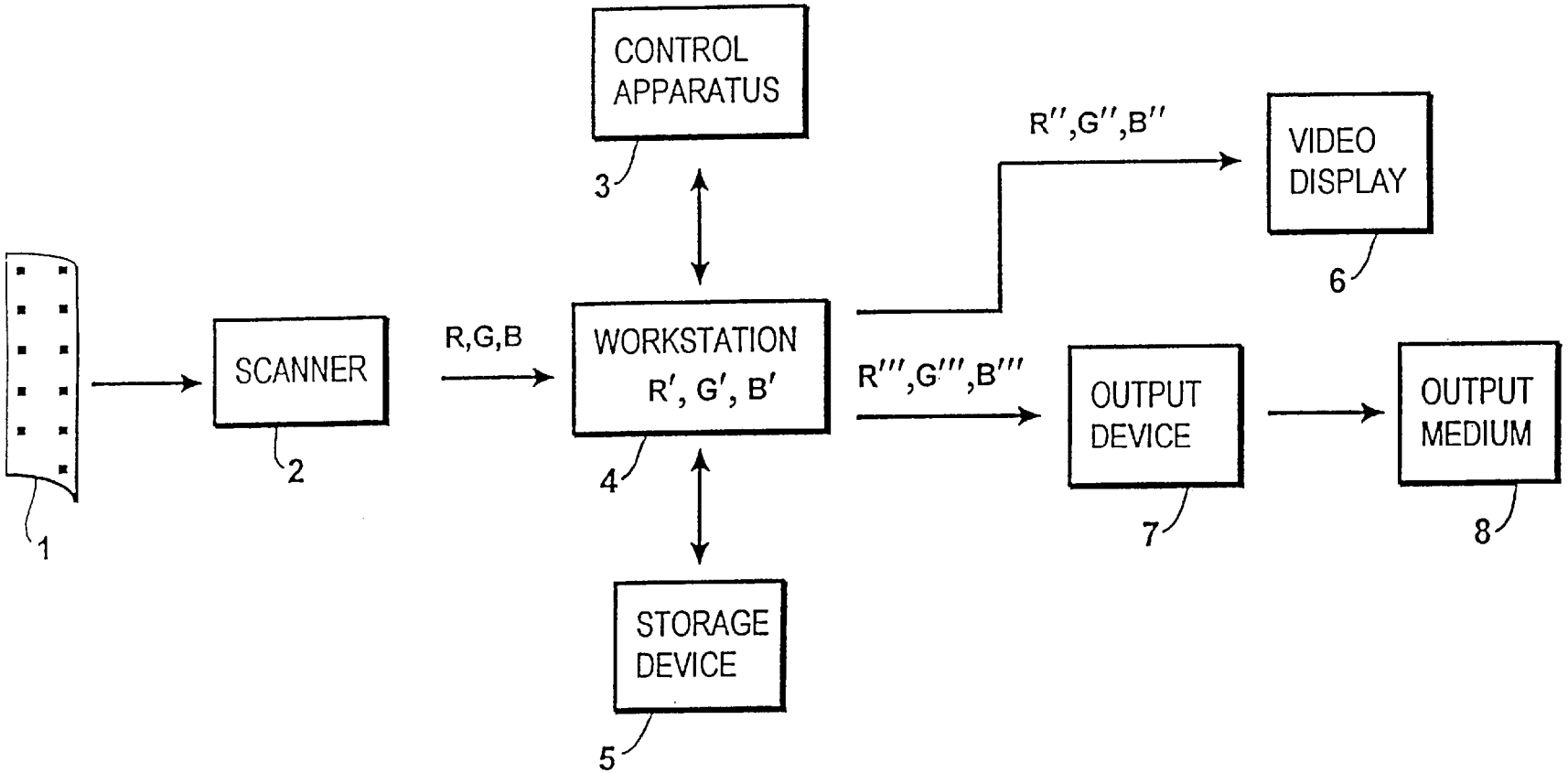
FIG. 1 shows in block diagram form an apparatus for processing and viewing image formation obtained by scanning a photographic element of this invention.

The principles of ion exchange are well known and are described, for example, in *Chemical Engineer's Handbook*, Fifth Edition, Section 16. Ion exchange materials generally consist of a solid phase containing bound groups that carry an ionic charge, either positive or negative, in conjunction with free ions of opposite charge that can be displaced. Ion exchange materials have the characteristic of selectively taking up and storing one or more ionized solute species from a fluid phase. The concentration of bound ionic groups in the ion exchange material is called the stoichiometric capacity. The maximum uptake of a specific solute by the ion exchange resin is related to the stoichiometric capacity of the resin and to the adsorption strength of the solute to those bound groups. Ionic exchange resins useful in this invention include, for example, organic synthetic resins, inorganic resins and the like.

Cation-exchange resins generally contain bound sulfonic acid groups (for example, $SO_3^-$). These resins are typically commercially available in either the acidic form or the sodium form. Additionally, cation-exchange resins contain other bound acid groups such as carboxylic, phosphonic, phosphinic, (for example, $COO^-$, $PO_3^{2-}$, $HPO_2^-$, $AsO_2^-$, $SeO_3^-$, etc). Preferred cationic ion exchange resins are sulfonated copolymers derived from styrene and divinylbenzene with a sulfonation level of about 3 to about 5 meq/g.

Anionic-exchange resins involve quaternary ammonium groups (strongly basic) or other amino groups (weakly basic). Such resins preferably contain one or more of the following ionic groups:

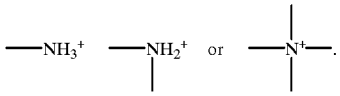

Preferred anionic ion exchange resins are derived from copolymers of styrene and divinylbenzene contain at least one of the above ionic groups. A preferred anionic ion exchange resin comprises a copolymer derived from styrene and divinylbenzene containing trimethylbenzylammonium chloride groups.

Ion exchange reactions are reversible and involve chemically equivalent quantities. It is possible to recover the solute and to purify and reuse the ion exchange resin. In this case, conditions for regeneration must also exist. This can be accomplished with a solution containing the ion initially present in the solid. An ever-present excess of this ion during the regeneration step will cause the reaction equilibrium to reverse itself, restoring the resin to its initial condition.

For use in this invention, the ion exchange matrix comprises particles having an average particle size of about 0.01 to about 10 micrometers ($\mu$m), more preferable about 0.05 to about 8 $\mu$m and most preferably about 0.1 to about 5 $\mu$m. Particles of the desired size can be prepared by standard techniques, such as milling, by preparing the particles by a limited coalescence procedure, or other procedures known in the art. Milling processes that can be used include, for example, processes described in U.K. Patent No. 1,570,632, and U.S. Pat. No. 3,676,147, 4,006,025, 4,474,872 and 4,948,718, the entire disclosures of which are incorporate herein by reference. Limited coalescence procedures that can be used include, for example, the procedures described in U.S. Pat. No. 4,994,3132, 5,055,371, 2,932,629, 2,394,530, 4,833,060, 4,834,084, 4,965,131 and 5,354,799, the entire disclosures of which are incorporated herein by reference.

As discussed more fully below, in preferred embodiments of this invention the ion exchange resin is used in a photographic element. In those embodiments the ion exchange matrix preferably has a refractive index between 1.4 and 1.7. This provides acceptable optical clarity in the processed photographic element.

The photographic element of this invention comprises at least one reducing agent ionically bound to an ion exchange matrix. The reducing agent is present in an amount of about 5 to about 100, preferably about 10 to about 90 and most preferably about 15 to about 90 mol percent of the ion exchange stoichiometric capacity of the ion exchange resin. The terms "acid" and "acidic", "base" and "basic" are used herein to refer to compounds known as Lewis acids and Lewis bases. Acids are molecules or ions capable of coordinating with unshared electron pairs and bases are molecules or ions which have such unshared electron pairs available for coordination. Lewis acids will coordinate with the anionic exchangers, and Lewis bases with the cation exchangers.

The reducing agent compound can be, for example, a photographic developer, a blocked developer, a developer precursor, an electron transfer agent, a blocked electron transfer agent, and an electron transfer agent precursor and the like.

In a preferred embodiment of the invention, the reducing agent is a developer. The developer can be an active developer or a blocked developer. A discussion of developers can be found in Research Disclosure, September 1996, Number 389, Item 38957 Section XIX, subsection A. September 1996, Number 389, Item 38957 (hereafter referred to as ("Research Disclosure I"). All sections referred to herein are sections of Research Disclosure I, unless otherwise indicated. (All Research Disclosures referenced herein are published by Kenneth Mason Publications, Ltd., Dudley Annex, 12a North Street, Emsworth, Hampshire P010 7DQ, ENGLAND). The developer can be organic or inorganic. Useful classes of organic developing agents include hydroquinones, catechols, aminophenols, pyrazolidones, phenylenediamines, tetrahydroquinolines, bis(pyridone) amines, cycloalkenones, pyrimidines, reductones and coumarins. Useful inorganic developing agents include compounds of a metal having at least two distinct valence states, which compounds are capable of reducing ionic silver to metallic silver. Such metals include iron, titanium, vanadium and chromium, and the metal compounds employed are typically complexes with organic compounds such as polycarboxylic acids or aminopolycarboxylic acids.

Included among useful developing agents are the iodohydroquinones of Duennebier et al U.S. Pat. No. 3,297,445, the aminohydroxy cycloalkenones of Gabrielsen et al U.S. Pat. No. 3,690,872, the 5-hydroxy and 5-aminopyrimidines of Wyand et al U.S. Pat. No. 3,672,891, the N-acyl derivatives of p-aminophenols of Porter et al U.K. Patent 1,045,303, the 3-pyrazolidones of Kendall U.S. Pat. No. 2,289,367, Allen U.S. Pat. No. 2,772,282, Ishikawa et al U.S. Pat. No. 4,845,016 Stewart et al U.K. Patent 1,023,701 and DeMarle et al U.S. Pat. Nos. 3,221,023 and 3,241,967, the anhydrodihydro reductones of Gabrielsen et al U.S. Pat. No. 3,672,896, the heterocyclic-sulfonhydrazides of Clarke et al EPO 0 545 491, the N-(4-aminophenyl)pyrrolidine derivatives of Ohki et al U.S. Pat. No. 5,278,034, the 6-aminotetrahydroquinolines of Taniguchi et al EPO 0 670 312, the heterocyclic compounds of Hagemann DE 4,241,532, and the 6-hydroxy and 6-aminocoumarins of Oftedahl U.S. Pat. No. 3,615,521. Particularly useful primary aromatic amino color developing agents are the p-phenylenediamines and especially the N-N-dialkyl-p-phenylenediamines in which the alkyl groups or the aromatic nucleus can be substituted or unsubstituted. Common p-phenylenediamine color developing agents are N-N-diethyl-p-phenylenediamine monohydrochloride, 4-N,N-diethyl-2-methylphenylenediamine monohydro-chloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylene-diamine sulfate. Other p-phenylenediamines, similar compounds, and their use include those described in Nakamura et al U.S. Pat. No. 5,427,897, Mihayashi et al U.S. Pat. No. 5,380,625, Haijima et al U.S. Pat. No. 5,328,812, Taniguchi et al U.S. Pat. No. 5,264,331, Kuse et al U.S. Pat. No. 5,202,229, Mikoshiba et al U.S. Pat. No. 25 5,223,380, Nakamuara et al U.S. Pat. No. 5,176,987, Yoshizawa et al U.S. Pat. No. 5,006,437, Nakamuara U.S. Pat. No. 5,102,778 and Nakagawa et al U.S. Pat. No. 5,043,254. Advantageous results can be obtained with combinations of organic and inorganic developing agents as described in Vought Research Disclosure, Vol. 150, October, 1976, Item 15034, and with combinations of different types of organic developing agents such as the combination of anhydrodihydroamino reductones and aminomethyl hydroquinones of Youngquist U.S. Pat. No. 3,666,457, the combination of a color developer and a 3-pyrazolidone of Twist WO 92/10789 and the combination of ascorbic acid and 3-pyrazolidone of Sutherns U.K. Patent 1,281,516. Developing agents can be incorporated in photographic elements in the form of precursors. Examples of such precursors include the halogenated acyl hydroquinones of Porter et al U.S. Pat. No. 3,246,988, the N-acyl derivatives of aminophenols of Porter et al U.S. Pat. No. 3,291,609, the reaction products of a catechol or hydroquinone with a metal described in Barr U.S. Pat. No. 3,295,978, the quinhydrone dyes of Haefner et al U.S. Pat. No. 3,565,627, the cyclohex-2-ene-1,4-diones and cyclohex-2-ene-1-one-4-monoketals of Chapman et al U.S. Pat. No. 3,586,506, the Schiff bases of p-phenylenediarnines of Pupo et al Research Disclosure, Vol. 151, November, 1976, Item 15159 and the blocked developers of Southby et al U.S. Pat. No. 5,256,525. Precursors may also be contained in developing solutions as described in Mikoshiba et al EPO 0 393 523 and Yagihara et al U.S. Pat. No. 5,002,862. When incorporated, the developing agents can be present in one or more hydrophilic colloid layers of the photographic element, such as a silver halide emulsion layer or a layer adjacent the silver halide layer, as illustrated by Haefner U.S. Defensive Publication T-882020. The developing agent can be added to the layer in the form of a dispersion with a film-forming polymer in a water-immiscible solvent as illustrated by Dunn et al U.S. Pat. No. 20 3,518,088, as a dispersion with a polymer latex as illustrated by Chen Research Disclosure, Vol.159, July, 1977, Item 15930, and Pupo et al Research Disclosure, Vol. 148, August, 1976, Item 14850, or as a solid particle dispersion as described by Texter et al U.S. Pat. No. 5,240,821. Incorporated primary amine color developing agents or precursors therefore are also used in photographic elements that are processed in low volumes of processing solutions as described by Texter et al U.S. Pat. No. 5,411,840.

Preferred developers include aminophenols, phenylenediamines, hydroquinones and pyrazolidones. Representative patents describing such developing agents are U.S. Pat. Nos. 2,193,015; 2,108,243; 2,592,364; 3,656,950; 3,658,525; 2,751,297; 2,289,367; 2,772,282; 2,743,279; 2,753,256; and 2,304,953.

Structures of preferred developing agents are:

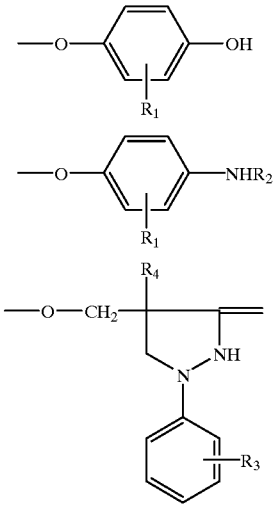

-continued

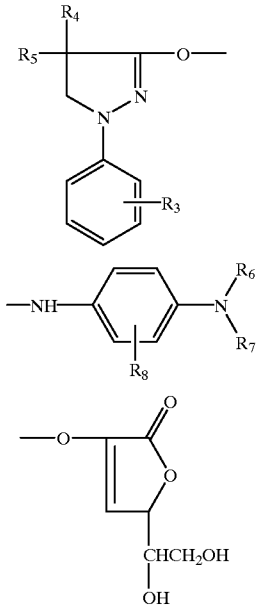

herein $R_1$ is hydrogen, halogen (e.g. chloro, bromo), alkyl or alkoxy (preferably of 1 to 4 carbon atoms); $R_2$ is hydrogen or alkyl (preferably of 1 to 4 carbon atoms); $R_3$ is hydrogen, alkyl, alkoxy or alkenedioxy (preferably of of 1 to 4 carbon atoms); and $R_4$, $R_5$, $R_6$, $R_7$ and $R_8$ are individually hydrogen, alkyl, hydroxyalkyl or sulfoalkyl (preferably of 1 to 4 carbon atoms).

Particularly preferred developers are, p-phenylenediamines or p-aminophenols. Especially preferred are p-phenylenediamines.

In other preferred embodiments of the invention, the reducing agent is an electron transfer agent, a blocked electron transfer agent or an electron transfer agent precursor. The term "electron transfer agent" or ETA is employed in its art recognized sense of denoting a silver halide developing agent that donates an electron (becomes oxidized) in reducing $Ag^+$ in silver halide to silver $Ag^o$ and is then regenerated to its original non-oxidized state by entering into a redox reaction with primary amine color developing agent. In the redox reaction the color developing agent is oxidized and hence activated for coupling.

Preferred electron tansfer agents 1-aryl-3-pyrazolidinone derivatives, a hydroquinone or derivative thereof, a catechol or derivative thereof, or an acylhydrazine or derivative thereof The electron transfer agent pyrazolidinone moieties which have been found to be useful in providing development acceleration finction are derived from compounds generally of the type described in U.S. Pat. Nos. 4, 209,580; 4,463,081; 4,471,045; and 4,481,287 and in published Japanese patent application No. 62-123,172. Such compounds comprise a 3-pyrazolidinone structure having an unsubstituted or substituted aryl group in the 1-position. Preferably these compounds have one or more alkyl groups in the 4 or 5-positions of the pyrazolidinone ring. Particularly useful electron ransfer agents are described in Platt et al U.S. Pat. No. 4,912,025, and Michno et al U.S. Pat. No. 4,859,578.

The ionically bound reducing agent may be used in any form of photographic system. In a preferred embodiment of the invention the photographic element is a color negative film. Prints can be made from the film by conventional optical techniques or by scanning the film and printing using a laser, light emitting diode, cathode ray tube or the like.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV Supports of Research Disclosure I, Photographic elements of the present invention may also usefully include a magnetic recording material as described in Research Disclosure, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than about 35 μm and preferably less than about 25 μm and most preferably less than about 20 μm.

Any convenient selection from among conventional radiation-sensitive silver halide emulsions can be incorporated within the layer units and used to provide the spectral absorptances of the invention. Most commonly high bromide or high chloride emulsions containing a minor amount of iodide are employed. To realize higher rates of processing, high chloride emulsions can be employed. Radiation-sensitive silver chloride, silver bromide, silver iodobrornide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Further, the tabular grains can have either {111} or {100} major faces. Specifically preferred tabular grain emulsions are those having a tabular grain average aspect ratio of at least 5 and, optimally, greater than 8. Preferred mean tabular grain thicknesses are less than 0.3 μm (most preferably less than 0.2 μm). Ultrathin tabular grain emulsions, those with mean tabular grain thicknesses of less than 0.07 μm, are specifically contemplated. The grains preferably form surface latent images so that they produce negative images when processed in a surface developer in color negative film forms of the invention.

Illustrations of conventional radiation-sensitive silver halide emulsions are provided by Research Disclosure, Item 38957, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in Research Disclosure, Item 38957, cited above and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in Research Disclosure, Item 38957. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light-sensitive silver, as silver halide, can be employed in the elements useful in this invention, it is preferred that the total quantity be less than 10 $g/m^2$ of silver. Silver quantities of less than 7 $g/m^2$ are preferred, and silver quantities of less than 5 $g/m^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per $m^2$ of support surface area in the element is preferred so as to realize an exposure latitude of at least 2.7 log E while maintaining an adequately low graininess position for pictures intended to be enlarged. For color display elements, substantially lower silver coating coverages are typically employed.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by Research Disclosure, Item 38957, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light-sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order. to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by Research Disclosure, Item 38957, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by Research Disclosure, Item 38957, VII. Absorbing and scattering materials, B. Absorbing materials.

The antihalation layer unit AHU typically contains a processing solution removable or decolorizable light absorbing material, such as one or a combination of pigments and dyes. Suitable materials can be selected from among those disclosed in Research Disclosure, Item 38957, VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by Research Disclosure, Item 38957, IX. Coating physical property modifying addenda. The SOC overlying the emulsion layers additionally preferably contains an ultraviolet absorber, such as illustrated by Research Disclosure, Item 38957, VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The finction of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forning couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsior layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements useful in the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma as low as 1.0 or even 0.6 are contemplated and exposure latitudes of up to about 5.0 log E or higher are feasible. Gammas of about less than about 0.55 are preferred. Gammas of between about 0.4 and about 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by Research Disclosure, Item 38957, X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver supportcan be reflective, as is commonly the choice when the dye image is intended to be viewed, or transparent, which allows transmission scanning of the dye image. RDR's as well as dye image transfer systems in which they are incorporated are described in Research Disclosure, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in Research Disclosure, Vol. 176, December 1978, Item 17643, XXIII. Image transfer systems.

A number of modifications of color negative elements have been suggested for accommodating scanning, as illustrated by Research Disclosure I, XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described by Arakawa et al U.S. Pat. No. 5,962,205, the disclosures of which are incorporated herein by reference. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye formiing units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the SPSE *Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed.

The term "gamma ratio" when applied to a color recording layer unit refers to the ratio determined by dividing the color gamma of a cited layer unit after imagewise color separation exposure and process that enables development of primarily that layer unit by the color gamma of te same layer unit after imagewise white light exposure and process that enables develpmnet of all layer units. This term relates to the degree of color saturation available from that layer unit after conventional optical printing. Larger values of the gamma ratio indicate enhanced degrees of color saturation under optical printing conditions.

Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light-sensitive color forming units each exhibit gamma ratios of less than 1.15. In an even more preferred embodiment, the red and blue light-sensitive color forming units each exhibit gamma ratios of less than 1.10. In a most preferred embodiment, the red, green, and blue light-sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described atNakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with. modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221. More generally, the size limited cameras most useful as one-time-use cameras will be generally rectangular in shape and can meet the requirements of easy handling and transportability in, for example, a pocket, when the camera as described herein has a limited volume. The camera should have a total volume of less than about 450 cubic centimeters (cc's), preferably less than 380 cc, more preferably less than 300 cc, and most preferably less than 220 cc. The depth-to-height-to-length proportions of such a camera will generally be in an about 1:2:4 ratio, with a range in each of about 25% so as to provide comfortable handling and pocketability. Generally the rninimum usable depth is set by the focal length of the incorporated lens and by the dimensions of the incorporated film spools and cartridge. The camera will preferably have the majority of comers and edges finished with a radius-of-curvature of between about 0.2 and 3 centimeters. The use of thrust cartridges allows a particular advantage in this invention by providing easy scanner access to particular scenes photographed on a roll while protecting the film from dust, scratches, and abrasion, all of which tend to degrade the quality of an image.

While any known taking lens may be employed in the cameras of this invention, the taking lens mounted on the single-use cameras of the invention are preferably single aspherical plastic lenses. The lenses will have a focal length between about 10 and 100 mm, and a lens aperture between f/2 and f/32. The focal length is preferably between about 15 and 60 mm and most preferably between about 20 and 40 mm. For pictorial applications, a focal length matching to within 25% the diagonal of the rectangular film exposure area is preferred. Lens apertures of between f/2.8 and f/22 are contemplated with a lens aperture of about f/4 to f16 being preferred. The lens MTF can be as low as 0.6 or less at a spatial frequency of 20 lines per millimeter (lpm) at the film plane, although values as high as 0.7 or most preferably 0.8 or more are contemplated. Higher lens MTF values generally allow sharper pictures to be produced. Multiple lens arrangements comprising two, three, or more component lens elements consistent with the functions described above are specifically contemplated.

Cameras may contain a built-in processing capability, for example a heating element. Designs for such cameras including their use in an image capture and display system are disclosed in U.S. patent application Ser. No. 09/388,573, incorporated herein by reference.

Photographic elements of the present invention are preferably imagewise exposed using any of the known techniques, including those described in Research Disclosure I, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The ion exchanged reducing agent of this invention may be used in photographic elements that contain any or all of the features discussed above, but are intended for different forms of processing. These types of systems will be described in detail below.

Type I: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing.

Type II: Conventional photographic systems, where film elements are processed by contact with conventional photographic processing solutions, and the volume of such solutions is very large in comparison to the volume of the imaging layer.

Type I: Low Volume Processing:

In accordance with another aspect of this invention the ion exchanged reducing agent is incorporated in a photographic element intended for low volume processing. Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of photographic processing, using the methods described below.

The Type I photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a imagewise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Type II: Conventional Systems:

In accordance with another aspect of this invention the ion exchanged reducing agent is incorporated in a conventional photographic element.

Conventional photographic elements in accordance with the invention can be processed in any of a number of well-known photographic processes utilizing any of a number of well-known conventional photographic processing solutions, described, for example, in Research Disclosure I, or in T. H. James, editor, *The Theory of the Photographic Process*, 4th Edition, Macmillan, New York, 1977. The development process may take place for any length of time and any process temperature that is suitable to render an acceptable image. In these cases the presence of ion exchanged developers of the invention may be used to provide development in one or more color records of the element, supplementary to the development provided by the developer in the processing solution to give improved signal in a shorter time of development or with lowered laydowns of imaging materials, or to give balanced development in all color records. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development may be followed by bleach-fixing, to remove silver or silver halide, washing and drying.

In embodiments of the invention in which an ion exchanged developer is used in each of the color records or in light-insensitive layers adjacent the color records, it is contemplated that the processing solution will contain little, if any, developer. However, in embodiments of the invention in which the reducing agent is other than a developer then the processing solution will contain a developer.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing inage quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and *Madden Digital Color Management, Addison-Wesley,* 1998.

FIG. 1 shows, in block diagram form, the manner in which the image information provided by the color negative elements of the invention is contemplated to be used. An image scanner 2 is used to scan by transmission an image-wise exposed and photographically processed color negative element 1. The scanning beam is most conveniently a beam of white light that is split after passage through the layer units and passed through filters to create separate image records—red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhehning majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient element writer, such as a thermal dye transfer, ink-jet, electrostatic, electrophotographic, or other type of printer suitable for rendering a viewable image. The output device can be used to control the exposure of a silver halide color paper. The silver halide output medium and/or its method of processing may be conventional or modified according to the present invention. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements are converted to digital form, manipulated, and recreated in a viewable form following the procedure described in Giorgianni et al U.S. Pat. No. 5,267,030. Color negative recording materials can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
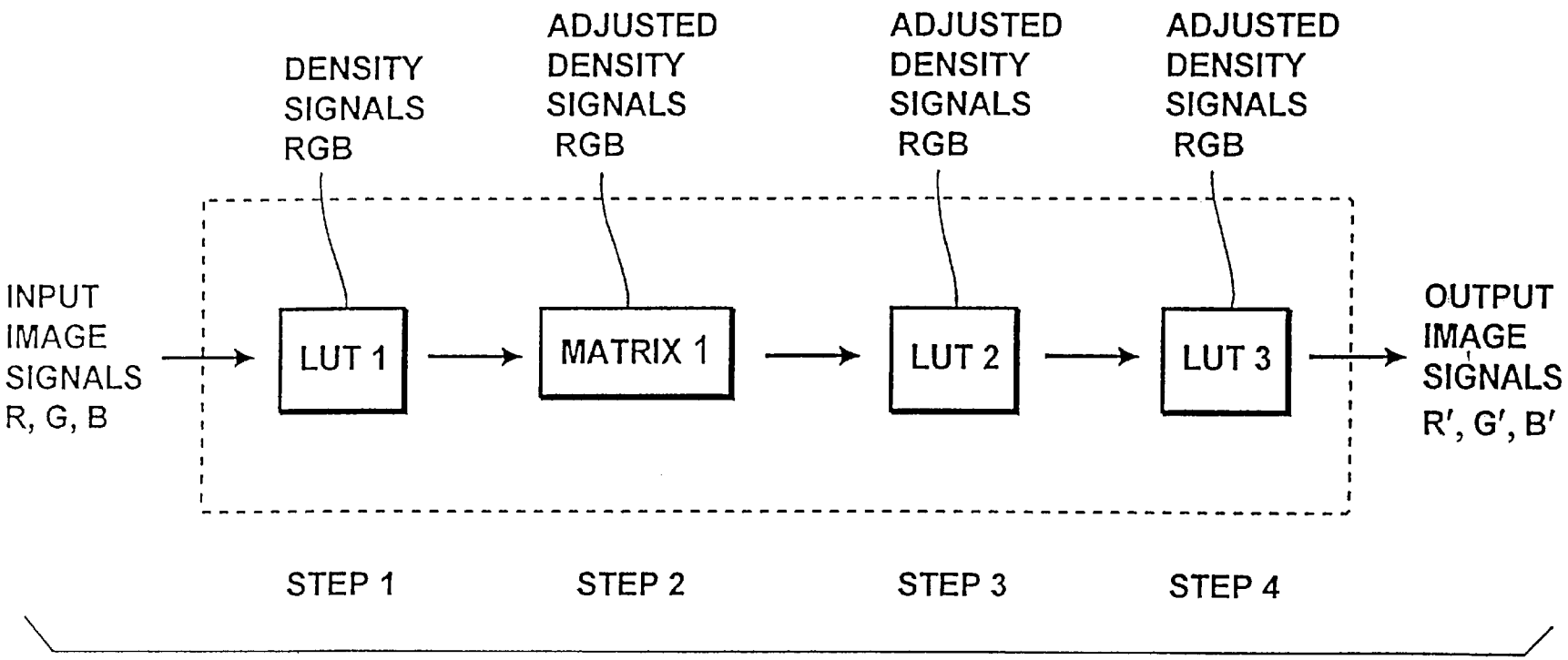
FIG. 2 is a block diagram showing electronic signal processing of image bearing signals derived from scanning a developed color element according to the invention.

Referring to FIG. 2, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond-to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by firther matrix transformation or 1-dimensional look-up table transformation, or a combination of such transformations to properly prepare the output image-bearing signals for any of the steps of transmitting, storing, printing, or displaying them using the specified device.

The R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G; and B image-bearing signals from a scanner would be transformed to the R', G', and B' intermediary density values corresponding to those of an image which would have been formed by the reference color negative film had it been exposed under the same conditions under which the color negative recording material was exposed.

Thus each input film would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

The following examples illustrate the invention and include use of both anionic- and cationic-exchange polymers to stabilize active or blocked color developing agents.

The following chemical structures represent compounds used in the examples.

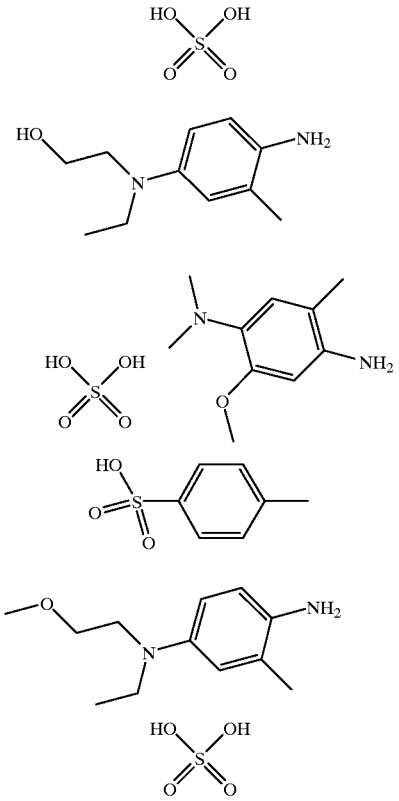

-continued

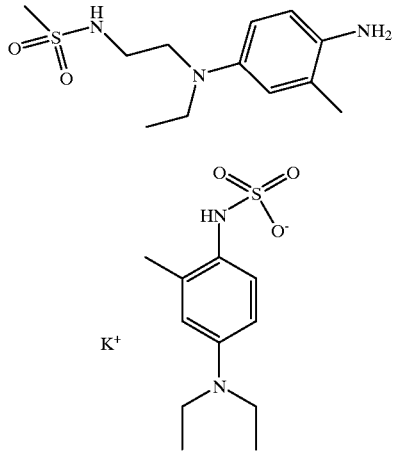

Preparative Examples

A series of developer loaded ion exchange particle slurries were prepared containing variable particle size as shown in Table 1. Samples of a commercially available ion exchange resin were loaded with developer as described below. Dispersal and particle size reduction of the resulting developer loaded ion exchange particles was accomplished by subjecting the particle slurry samples to a) high shear mixing with a rotor-stator mixer and/or b) repeated collisions with hard, inorganic milling media. Direct synthesis of ion exchange resin particles with the desired particle size was accomplished via suspension polymerization.

M1

To 40 g of solution A which contained 10 wt. % of DEV-1 and 2.4 wt. % of sodium sulfite were added 10 g of Amberlite™ IR120$^+$ strongly acidic gel-type ion exchange resin. The mixture was stirred for five minutes, and the resin particles were separated from the liquid phase. The resin particles were washed with distilled, de-ionized water until the pH of a 20% resin slurry was 4.7. The resulting developer loaded resin particles were added to 56.6 g of a solution containing 0.111 g of cetyltrimethylammonium bromide and 0.152 g of sodium sulfite. The sample was milled for 16 hours with 120 cc of 1.8 mm zirconium oxide beads in an 8 oz jar to produce dispersion M1. This dispersion contained a very broad particle size distribution, and no particles smaller than 20 microns were observed in dispersion M1.

M2

M2 was prepared by the same method as M1 except the resin particle slurry was sheared for 15 minutes with a rotor-stator mixer at ca. 15,000 RPM and milled for 2.5 hours with 120 cc of 1.8 mm zirconium oxide beads in an 8 oz jar. More than 95% of the particles in dispersion M2 were smaller than 10 microns, and no particles larger than 15 microns were observed. The average particle size was 2.5 microns.

M3

Dispersion M3 was prepared by the same method as M2 except this sample was milled for 16 hours. No particles larger than 2 microns were observed in dispersion M3.

M4

A sample of Dowex HCR-W2, Na+ form, spherical beads (strong acid; styrene-DVB copolymer; nuclear sulfonic acid active group; total exchange capacity=3.8 meq/g) was milled with 1 cm zirconium oxide media for 2 weeks and loaded with developer as follows. In 25 ml of water was dissolved 0.48 g of sodium sulfite followed by a 20 minute purge with nitrogen. To the purged solution was added 5.5 g of DEV-1, and 6.3 g of the 80% solids Dowex HCR-W2 milled dispersion. The resultant dispersion was shaken for 4 hours. The final resin was isolated by centrifugation, and was washed 3 times with distilled water followed by centrifugation each time to isolate the resin. The pH of the resulting 5% solids resin dispersion M4 was 6.0. No particles larger than 2 microns were observed in dispersion M4.

M5

To 14.6 g of solution A were added 25.4 g of distilled water and 20 g of Amberlite™ IR120$^+$ strongly acidic gel-type ion exchange resin. The mixture was stirred for five minutes, and the resin particles were separated from the liquid phase. The resin particles were washed with distilled, de-ionized water until the pH of a 20% resin slurry was 4.9. Five grams of the resulting developer loaded resin particles were added to 35 g of a solution containing 0.067 g of cetyltrimethylammonium bromide and 0.09 g of sodium sulfite. This slurry was sheared for 15 minutes with a rotor-stator mixer at ca. 15000 RPM. The resulting slurry was milled for 150 minutes with 120 cc of 1.8 mm zirconium oxide beads in an 8 oz jar to produce ion-exchanged developer M5.

P1

Direct synthesis of ion exchange resin particles with the desired particle size was also employed. Ion exchange resin particles were synthesized in the following manner. A copolymer resin comprising 85 wt % styrene, and 15 wt % divinylbenzene was synthesized by the well known suspension polymerization technique (McCaffery, Edward M.,: *Laboratory Preparation for Macromolecular Chemistry*, McGraw-Hill, Inc., 1970.). The reaction conditions produced a narrow size distribution of particles with the mean size of 3 um. The beads were treated with sulfuric acid at elevated temperatures for 9 hours, thoroughly washed with distilled water, and dried. The level of sulfonation was 6 meq/g. To 30 ml of water was added 0.48 g of sodium sulfite followed by a 20 minute purge with nitrogen. To the purged solution was added 5 g of the 3 um sized sulfonated beads, and 8.5 g of DEV-1. The dispersion was stirred for 4 hours. The isolation procedure of P1 was identical to M4.

P2

The procedure for obtaining 1.5 um size resin beads is the same procedure as used in the resin preparation for the P1 example except that more stabilizer was used in this preparation, in order to obtain the smaller resin bead size. The sulfonation of the resin, and work-up procedure was identical to the one used in the P1 example. In this case the sulfonation level on the resin was 5.1 meq/g. The ion-exchange procedure was identical to P1, keeping the molar ratio of sulfonic acid to DEV-1 constant in this preparation.

P3

The procedure for obtaining 8 um size resin beads is the same procedure as used in the resin preparation for the P1 example except that less stabilizer was used in this preparation, in order to obtain the larger resin bead size. The sulfonation of the resin, and work-up procedure was identical to the one used in the P1 example. In this case the sulfonation level on the resin was 5.1 meq/g. The ion-exchange procedure was identical to the procedure used in the P2 example.

P4

A sample containing 1.5 micron resin particles were loaded with developer in the identical manner as for P2, except the molar ratio of sulfonic acid to DEV-1 was 1:0.125.

P5

A sample containing 1.5 micron resin particles were loaded with developer in the identical manner as for P2, except the molar ratio of sulfonic acid to DEV-1 was 1:0.25.

TABLE 1

| | Particle size (microns) |
|---|---|
| M1 | Greater than 20 |
| M2 | 2.5 um |
| M3 | 0.8 um |
| M4 | 0.7 um |
| M5 | 2.5 um |
| P1 | 3 |
| P2 | 1.5 |
| P3 | 8 |
| P4 | 1.5 |
| P5 | 1.5 |

Emulsion E-1

A silver halide tabular emulsion with a composition of 97% silver bromide and 3% silver iodide was prepared by conventional means. The resulting emulsion had an equivalent circular diameter of 0.6 microns and a thickness of 0.09 microns. This emulsion was spectrally sensitized to green light and then chemically sensitized for optimum performance.

Evaluation Examples

Example 1

This example demonstrates ion exchanged developer sources with particle sizes below 10 microns are preferred. A set of coatings containing ion exchanged developers embedded in a photosensitive layer were prepared, exposed and processed as follows. Coatings were prepared containing on a 1 m$^2$ basis: 0.54 g of silver from silver halide emulsion E-1, 0.32 g of magenta dye-forning coupler 224EV, 0.27 g of DEV-1 from the ion-exchanged developer source indicated in Table 3, and 4.04 g of de-ionized gelatin. The resulting coatings were exposed through a 0–4 neutral density step tablet and a Wratten 9™ filter for 1" with a 5500K light source.

A set of coatings was processed by immersion in a 0.5M sodium carbonate solution at 60° F. for 30 seconds, fixed, washed and dried. Photographic performance is described in Table 2. Photographic speed was defined as the exposure at which the density above Dmin is 20% of the average gradient from that point to 0.6 log E greater exposure.

Results in Table 2 clearly show an advantage from employing ion exchange polymers with particle sizes smaller than 10 microns. The D-max obtained in the comparison coating of M1 resulted in a D-max of only 0.16, compared to D-max densities of at least 1.95 for the coatings containing smaller particles of developer loaded ion exchange polymers.

TABLE 2

| | Particle Size (microns) | D-min | D-max | Speed |
|---|---|---|---|---|
| M1 (comparison) | >20 | 0.03 | 0.16 | Not measurable |
| M2 | 2.5 | 0.06 | 2.15 | 248 |
| M3 | 0.8 | 0.06 | 2.71 | 251 |
| M4 | 0.7 | 0.07 | 2.10 | 241 |
| M5 | 2.5 | 0.09 | 1.95 | 256 |

TABLE 2-continued

| | Particle Size (microns) | D-min | D-max | Speed |
|---|---|---|---|---|
| P1 | 3 | 0.06 | 2.20 | 252 |
| P2 | 1.5 | 0.06 | 2.10 | 240 |
| P3 | 8 | 0.08 | 2.00 | 249 |

Example 2

A set of coatings containing ion exchanged developers embedded in a photosensitive layer were prepared, exposed and processed in the same way as described in Example 1, except the process also included a 5 minute soak in de-ionized water before immersion in the sodium carbonate activator. A comparison coating DEV-1 was also included which was prepared with the same format except the developer was added using solution A and this coating did not contain ion-exchange particles. This distilled water pre-soaking experiment was used to demonstrate that the ion-exchange polymer adequately limits diffusion of the developer prior to immersion in the activator solution. Because the low pH of the pre-soak bath does not favor silver halide development, mobile developer species are washed out of the coatings without developing exposed silver halide emulsion grains. Subsequent immersion in the activator solution results in image formation from any remaining developer. The results in Table 3 show that pre-soaking comparison coating DEV-1 (which does not contain the ion-exchanged polymer) led to nearly complete loss of developer from the coating. As a result, only an extremely faint image was observed upon subsequent treatment with the activator solution. In contrast, the photographic performance of coatings containing ion-exchanged developer sources was not substantially affected by the pre-soak treatment. These results clearly demonstrate the usefulness of the ion-exchange polymers to limit unwanted diffusion of developer species incorporated in silver halide films. Results in Table 3 also clearly show an advantage from employing ion exchange polymers with particle sizes smaller than 10 microns. The D-max obtained in the comparison coating of M1 resulted in a D-max of only 0.16, compared to D-max densities of at least 1.85 for the coatings containing smaller particles of developer loaded ion exchange polymers.

TABLE 3

| | Particle Size, | With Pre-soak | | |
|---|---|---|---|---|
| | microns | D-min | D-max | Speed |
| M1 (comparison) | >20 | 0.03 | 0.16 | Not measurable |
| DEV-1 (comparison) | No resin | 0.03 | 0.21 | not measurable |
| M5 | 2.5 | 0.05 | 1.92 | 240 |
| M3 | 0.8 | 0.8 | 2.57 | 251 |
| M4 | 0.7 | 0.05 | 1.91 | 239 |
| P1 | 3 | 0.06 | 1.85 | 254 |

Example 3

This example demonstrates ion exchanged developer sources with particle sizes below 10 microns are preferred. Visual inspection of the samples described in example 1 revealed tremendous differences in image quality. Samples of comparison coating M1 described in example 1 were judged unacceptable. In addition to the low D-max density of coating M1 reported in Table 2, the image in a region of uniform exposure consisted of dense specks of image dye surrounded by regions where no image dye was formed. These image dye specks were approximately the same size as the developer-loaded ion exchange resin particles. Samples of the inventive examples described in example 1 containing ion exchanged developer sources with particles below 10 microns had substantially superior image quality. In these samples, uniform dye images were formed in regions of uniform exposure.

Example 4

This example demonstrates improvements in photographic performance and shelf life are obtained when ion exchanged developer sources are embedded in a photosensitive layer. Samples of Amberlite IR120$^+$ exchange resin were loaded with developing agents DEV-2, DEV-3, and DEV-4 in the same manner as for M3, and coated as described in Ex. 1. Comparison coatings were prepared except the developing agent was added from solution rather than including the ion-exchange resin. The coatings were exposed and processed as described in Ex. 1. A second set of coatings was incubated for four weeks at 120° F. and 50% RH prior to exposure and processing. Photographic performance is described in Table 4. The % discrimination was calculated as the ratio of the difference between D-max and D-min of the incubated coating and the freshly processed coating. The results in Table 4 demonstrate that the ion-exchanged developer resins provided similar or superior fresh image discrimination, and speed relative to comparison coatings which did not contain the ion-exchange resin. No image was observed with any of the incubated comparison coatings. Up to 95% of the initial image was retained when the ion exchange resin was employed to stabilize the color developer.

TABLE 4

| Developers | Fresh D-min | Fresh D-max | Fresh Speed | % Discrimination for 4 week 120° F. |
|---|---|---|---|---|
| M3-DEV-1 | 0.06 | 2.71 | 251 | 94 |
| DEV-1 (comparison) | 0.05 | 2.41 | 214 | 0 (no image) |
| M3-DEV-2 | 0.035 | 0.54 | 194 | 85 |
| DEV-2 (comparison) | 0.045 | 0.48 | 193 | 0 (no image) |
| M3-DEV-3 | 0.069 | 2.61 | 230 | 72 |
| DEV-3 (comparison) | 0.056 | 2.28 | 230 | 0 (no image) |
| M3-DEV-4 | 0.085 | 2.62 | 221 | 95 |
| DEV-4 (comparison) | 0.067 | 2.60 | 143 | 0 (no image) |

Example 5

This example demonstrates improvements in shelf life are obtained when developer loaded ion exchange particles are embedded in a photosensitive layer. Coatings were prepared containing on a 1 $m^2$ basis: 0.54 g of silver from silver halide emulsion E-1, 0.32 g of 224EV, DEV-1 levels as shown in Table 5 below, and 4.04 g of de-ionized gelatin. Comparison coatings were prepared with the same format except the DEV-1 was added using solution A. The coatings were exposed and processed as described in Ex. 1. The results in Table 5 demonstrate that the ion-exchanged developer sources provided superior fresh speed relative to comparison coatings which did not contain the ion exchange resin. No image was observed on the incubated comparison coatings. When an ion exchange polymer was employed to stabilize the color developer, photographic performance was remarkably improved. These results clearly demonstrate the usefulness of the ion-exchanged developer resins to improve the shelf life of silver halide films with incorporated developers.

TABLE 5

| DEV-1 Source | DEV-1 level | Fresh Speed | Dis-crim-ination | 1 wk 120° F. Speed | % discriminati on 1 wk 120° F. |
|---|---|---|---|---|---|
| M5 | 9 | 252 | 0.8 | 252 | 94 |
| M5 | 15 | 259 | 1.44 | 296 | 73 |
| P4 | 9 | 243 | 1.34 | 252 | 81 |
| P5 | 15 | 259 | 1.60 | 272 | 98 |
| DEV-1 (comparison) | 9 | 224 | 0.65 | No image | 0 (no image) |
| DEV-1 (comparison) | 15 | 224 | 1.51 | no image | 0 (no image) |

Example 6

This example demonstrates coatings containing ion exchanged developer sources embedded in a photosensitive layer may be processed with different activator solutions. Coatings were prepared in the format described in example 5 which contained, on a 1 $m^2$ basis, 0.16 g of DEV-1 from P5. The coatings were exposed as described in example 5 and were processed in the following activators at 60° F. for the time indicated in Table 6. Photographic performance is described in Table 6. These results demonstrate that a number of different activator solutions may be used to obtain similar photographic performance.

TABLE 6

| Activator Composition | Time, seconds | D-min | D-max | Speed |
|---|---|---|---|---|
| 0.5 M Na2CO3 | 30 | 0.040 | 1.63 | 256 |
| 1 M NaOH | 30 | 0.073 | 1.87 | 248 |
| 0.1 M NaOH | 30 | 0.065 | 1.89 | 253 |
| 1 M NaCl at pH 12 | 30 | 0.057 | 0.73 | 250 |
| 1 M NaCl at pH 12 | 60 | 0.058 | 1.29 | 251 |
| 0.0325 M Na2HPO4 at pH 12 | 30 | 0.053 | 0.656 | 255 |
| 0.0325 M Na2HPO4 at pH 12 | 60 | 0.060 | 1.227 | 266 |

Example 7

This example demonstrates stabilization of a blocked developer using anionic-exchanged resin particles embedded in a photosensitive layer. Anionic blocked developer DEV-5 was exchanged to a quaternary ammonium resin as follows. Dowex$^R$ SBR ($Cl^-$) Form, Typel, Spherical Beads (strong base; styrene-DVB copolymer; trimethylbenzyl ammonium active group; total exchange capacity=3.1 meq/g) ion-exchange resin was milled to generate a dispersion with an average particle size of 0.7 um. To 38 ml of distilled water that had been purged with nitrogen was added 0.48 g of sodium sulfite, and 2 g of DEV-5. To 50 ml of distilled, nitrogen purged water was added 5 g of dried Dowex$^R$ SBR ($Cl^-$) producing a smooth dispersion. The solution of DEV-5 was added to the resin dispersion, and stirred for 48 hours. The work-up of the developer resin was identical to M4. Coatings were prepared containing, on a 1 $m^2$ basis, 0.55 g of DEV-5 exchanged to the anionic-exchange resin, 0.32 g of 224EV, 0.004 mmol of nitric acid, and 3.96 g of de-ionized gelatin. The coating was exposed as described in Ex. 1. The coating was heated for 20 seconds at 160 ° C. to generate free developer and otherwise processed as described in Ex. 1. A magenta-colored negative image was observed.

Example 8

This example demonstrates coatings containing developer loaded ion exchange particles embedded in a photosensitive layer are suitable for development when activated with a thin layer of liquid sufficient liquid to swell the emulsion layer. A sample of the coating containing M5 described in Example 1 was exposed and processed as described in Example 1 except the activator solution was uniformly applied in a thin layer (10 microns) sufficient to swell the light sensitive layer. Results shown in Table 7 demonstrate that the ion-exchanged developers are a useful developer source for development schemes utilizing minimal activator solution usage.

TABLE 7

| Developer source | D-min | D-max | Speed |
|---|---|---|---|
| M5 | 0.11 | 2.08 | 248 |
| DEV-1 (comparison) | 0.22 | 2.35 | 220 |

Example 9

This example demonstrates coatings containing developer loaded ion exchange particles embedded in a binder are suitable for development of color print material. Ion-exchanged developer donor coatings were prepared containing, on a 1 $m^2$ basis, 0.65 g of DEV-1 from P5 and 4.31 g of de-ionized gelatin. Samples of Ektacolor Edge7 Color Paper were exposed to white light through a 0–4 neutral density step tablet and processed in the following manner. A thin layer (30 microns) of 0.5 M $Na_2CO_3$ solution was uniformly applied to the color paper,and brought in contact with the ion-exchanged developer donor. The coatings were passed through a set of pinch rollers, and heated for 10" at 50° C., then peeled apart, fixed and washed. Status A reflection densities are shown in Table 8.

TABLE 8

| | D-min | D-max |
|---|---|---|
| Red Reflection Density | 0.07 | 2.53 |
| Green Reflection Density | 0.09 | 2.49 |
| Blue Reflection Density | 0.14 | 2.43 |

Example 10

This example demonstrates coatings containing developer loaded ion exchange particles embedded in a binder are suitable for development of color negative film. Ion-exchanged developer donor coatings were prepared containing, on a 1 $m^2$ basis, 0.65 g of DEV-1 from P5 and 4.31 g of de-ionized gelatin. Samples of a 400 speed color negative film were exposed to white light through a 0–4 neutral density step tablet, and processed in the following manner. The exposed color negative film was immersed for 15 seconds in 1 M KOH and brought in contact with the ion-exchanged developer donor. The coatings were passed through a set of pinch rollers and held at room temperature for 60 seconds, then peeled apart, fixed and washed, to reveal a neutral negative image. Status M transmission densities are shown in Table 9.

TABLE 9

| | D-min | D-max |
|---|---|---|
| Red Density | 1.0 | 2.34 |
| Green Density | 1.35 | 2.84 |
| Blue Density | 1.70 | 2.94 |

Example 11

This example demonstrates developer loaded ion exchange particles embedded in a non-photosensitive layer of color negative film may be processed using an activator solution. A 100 speed color negative film element was prepared which contained a non-imaging overcoat with, on a a 1 $m^2$ basis, 0.65 g of DEV-1 from P1 and 3.96 g of de-ionized gelatin. Samples of this film were loaded in a camera and imagewise exposed. The exposed film was processed as described in Ex. 1. The resulting film strip was scanned using a PhotoCD scanner, the images were viewed using Photoshop 4.0, and printed with a Kodak DS8650, a thermal printer. High quality color images were obtained.

The invention has been described in detail with particular reference to certain preferred embodiments thereof, but it will be understood that variations and modifications can be effected within the spirit and scope of the invention.

What is claimed is:

1. A photographic element comprising a support, at least one light-sensitive silver halide layer and a reducing agent ionically bound to a particulate ion exchange matrix having an average particle size of about 0.01 to about 10 $\mu$m.

2. A photographic element according to claim 1, wherein the reducing agent is chosen from the group consisting of a photographic developer, a blocked developer, a developer precursor, an electron transfer agent, a blocked electron transfer agent, and an electron transfer agent precursor.

3. A photographic element according to claim 1, wherein the ion exchange matrix has a refractive index between 1.4 and 1.7.

4. A photographic element according to claim 1, wherein the ion exchange matrix is an organic synthetic resin.

5. A photographic element according to claim 4, wherein the ion exchange matrix is a cationic ion exchange resin.

6. A photographic element according to claim 5, wherein the cationic ion exchange resin carries one or more of the following ionic groups: $SO_3^-$, $COO^-$, $PO_3^{2-}$, $HPO_2^-$, $AsO_2^-$ $SeO_3^-$.

7. A photographic element according to claim 6, wherein the cationic ion exchange resin carries $SO_3^-$ ionic groups.

8. A photographic element according to claim 6, wherein the cationic ion exchange resin carries $COO^-$ ionic groups.

9. A photographic element according to claim 6, wherein the cationic ion exchange resin is a sulfonated coploymer derived from styrene and divinylbenzene having a sulfonation level between about 3 to about 5 meq/g.

10. A photographic element according to claim 4, wherein the ion exchange matrix is an anionic ion exchange resin.

11. A photographic element according to claim 10, wherein the anionic ion exchange resin carries one or more of the following ionic groups.

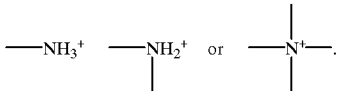

12. A photographic element according to claim 10, wherein the anionic ion exchange resin comprises a copolymer derived from styrene and divinylbenzene containing trimethylbenzylammonium chloride.

13. A photographic element according to claim 1, wherein the reducing agent is a developer.

14. A photographic element according to claim 1, wherein the reducing agent is a blocked developer.

15. A photographic element according to claim 14, wherein the blocked developer releases a p-phenylenediamine.

16. A photographic element according to claim 13, wherein the developer is a color developer.

17. A photographic element according to claim 16, wherein the color developer is a blocked color developer.

18. A photographic element according to claim 16, wherein the color developer is a p-phenylenediamine or p-aminophenol.

19. A photographic element according to claim 18, wherein the color developer is a p-phenylenediamine.

20. A photographic element according to claim 1, wherein the reducing agent ionically bound to an ion exchange matrix is in the light-sensitive layer.

21. A photographic element according to claim 1, wherein the photographic element further comprises a light-insensitive layer and the reducing agent ionically bound to an ionic exchange matrix is in the light-insensitive layer.

22. A photographic element according to claim 21, wherein the light-insensitive layer is adjacent the light-sensitive layer.

23. A photographic element according to claim 1, wherein the ion exchange matrix comprises a water-insoluble polymer.

24. A photographic element according to claim 1, wherein the reducing agent is present in an amount of about 5 to about 100 mol percent of the ion exchange stoichiometric capacity.

25. A method of activating a reducing agent incorporated in a photographic element which comprises a support, at least one light-sensitive silver halide emulsion layer, and at least one reducing agent ionically bound to a particulate ion exchange matrix having an average particle size of about 0.01 $\mu$m to about 10 $\mu$m, said method comprising contacting the element with a solution, or a solution contained within an ionic binder, having an ionic strength of greater than 0.001 M.

26. A method according to claim 25, wherein the process is conducted at elevated temperature.

27. A method according to claim 25, wherein the amount of activator solution is about 5% to about 150% of the amount needed to fully swell the coating.

28. A method of activating a reducing agent incorporated in a photographic element which comprises a support, at least one light sensitive layer and at least one reducing agent ionically bound to a particulate ion exchange matrix having an average particle size of about 0.01 to about 10 $\mu$m, said method comprising heating the element to a temperature above about 50° C.

29. A method of processing a photographic element which comprises a support, at least one light-sensitive silver halide emulsion layer, and an ion exchange material having an average particle size of about 0.01 to about 10 $\mu$m and comprising a reducing agent bound ionically to an ion exchange resin, said method comprising contacting the element with a processing solution having a pH greater than 8.

30. A method of according to claim 29, wherein the processing solution is sodium hydroxide or sodium carbonate.

31. A method according to claim 29, wherein the process is conducted at elevated temperature.

32. A method according to claim 29, wherein the amount of activator solution is about 5% to about 150% of the amount needed to fully swell the coating.

33. A method of imaging comprising the steps of:

forming an image in an imagewise exposed light-sensitive silver halide element comprising a support, a light-sensitive silver halide emulsion layer, and a reducing agent ionically bound to a particulate ion exchange material having an average particle size of about 0.01 and about 10 $\mu$m;

scanning said formed image to form a first electronic image representation from said formed image;

digitizing said first electronic image to form a digital image;

modifying said digital image to form a second electronic image representation; and transforming, storing, transmitting, printing or displaying said second electronic image representation.

34. A method of forming an image comprising the steps of:

forming an image in an imagewise exposed light-sensitive silver halide element comprising a support, a light-sensitive silver halide emulsion layer, and a reducing agent ionically bound to a particulate ion exchange material having an average particle size of about 0.01 and about 10 $\mu$m;

scanning said formed image to form an electronic image representation from said formed image; and transforming, storing, transmitting, printing or displaying said electronic image representation.

* * * * *